US009309885B2

(12) United States Patent
Blechschmidt

(10) Patent No.: US 9,309,885 B2
(45) Date of Patent: Apr. 12, 2016

(54) GEAR RING PUMP INCLUDING HOUSING CONTAINING PORT SUPPORT THEREIN WITH THE PORT SUPPORT FORMED OF A MATERIAL HAVING A GREATER HEAT EXPANSION COEFFICIENT THAN A MATERIAL OF THE HOUSING

(75) Inventor: Andreas Blechschmidt, Zella-Mehlis (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 83 days.

(21) Appl. No.: 14/232,007

(22) PCT Filed: Jun. 27, 2012

(86) PCT No.: PCT/DE2012/000650

§ 371 (c)(1),
(2), (4) Date: Jan. 10, 2014

(87) PCT Pub. No.: WO2013/007233

PCT Pub. Date: Jan. 17, 2013

(65) Prior Publication Data

US 2014/0154125 A1 Jun. 5, 2014

(30) Foreign Application Priority Data

Jul. 14, 2011 (DE) ..... 10 2011 107 157

(51) Int. Cl.
*F04C 15/00* (2006.01)
*F04C 2/10* (2006.01)

(52) U.S. Cl.
CPC ..... *F04C 15/0003* (2013.01); *F04C 2/10* (2013.01); *F04C 2/102* (2013.01); *F04C 15/0026* (2013.01); *F04C 2230/602* (2013.01)

(58) Field of Classification Search
USPC ..... 418/178, 61.3
See application file for complete search history.

(56) References Cited

U.S. PATENT DOCUMENTS

| | | | |
|---|---|---|---|
| 3,128,707 | A | 4/1964 | Brundage |
| 3,805,526 | A | 4/1974 | Charron |
| 6,769,889 | B1 | 8/2004 | Raney et al. |
| 7,614,227 | B2 | 11/2009 | Carlson et al. |
| 7,713,041 | B2 | 5/2010 | Bachmann et al. |
| 7,887,309 | B2 | 2/2011 | Bachmann et al. |

FOREIGN PATENT DOCUMENTS

| | | | |
|---|---|---|---|
| DE | 197 20 286 | A1 | 11/1998 |
| DE | 103 31 979 | A1 | 2/2005 |
| DE | 10 2008 054 758 | A1 | 6/2010 |
| GB | 943 624 | A | 12/1963 |
| JP | 07-208348 | A | 8/1995 |

OTHER PUBLICATIONS

International Search Report of PCT/DE2012/000650, mailed Nov. 21, 2012.

*Primary Examiner* — Jorge Pereiro
*Assistant Examiner* — Paul Thiede
(74) *Attorney, Agent, or Firm* — Collard & Roe, P.C.

(57) ABSTRACT

A gear ring pump includes a pump bearing arranged in the housing cover. A port support is mounted in the pump housing between the impeller set and the end wall of the working chamber in a movable manner towards the driveshaft such that the port support is prevented from rotating. The port support has a suction kidney and a pressure kidney which pass through the port support separately from each other across the entire width of the port support. The thickness of the port support approximately matches the thickness of the impeller set but can also project past the thickness of the impeller set by up to 20%. The thermal expansion coefficient of the port support is approximately 70% to 120% greater than the thermal expansion coefficient of the pump housing. The driveshaft which is rotationally fixed to the inner rotor does not protrude into the port support.

7 Claims, 4 Drawing Sheets

GEAR RING PUMP INCLUDING HOUSING CONTAINING PORT SUPPORT THEREIN WITH THE PORT SUPPORT FORMED OF A MATERIAL HAVING A GREATER HEAT EXPANSION COEFFICIENT THAN A MATERIAL OF THE HOUSING

CROSS REFERENCE TO RELATED APPLICATIONS

This application is the National Stage of PCT/DE2012/000650 filed on Jun. 27, 2012, which claims priority under 35 U.S.C. §119 of German Application No. 10 2011 107 157.5 filed on Jul. 14, 2011, the disclosure of which is incorporated by reference. The international application under PCT article 21(2) was not published in English.

BACKGROUND OF THE INVENTION

1. Field of the Invention

The invention relates to a gear ring pump, particularly for use in small pump assemblies, which are preferably driven by an electric motor, produced as modular pumps, and used in vehicle and engine construction.

2. Description of the Related Art

Gear ring pumps, for example in the design of gerotor pumps, are used in vehicle and engine construction, in internal combustion engines, among other things, as fuel pumps or as oil pumps.

The rotor set used in gerotor pumps consists of an inner rotor having gear teeth on the outside and an outer rotor having gear teeth on the inside, whereby the inner rotor is connected with the drive shaft in torque-proof manner and has fewer teeth than the outer rotor, and the outer rotor is mounted so as to rotate in a cylindrical chamber of the pump housing, in such a manner that the teeth of the inner rotor, which is mounted eccentric to the outer rotor, mesh with the teeth of the outer rotor in certain regions.

In the pressure and suction region of the rotor set, kidney-shaped pump chambers (pressure and suction kidney(s)) are disposed in the pump housing, which stand directly in connection with pressure and suction connector lines disposed on the pump housing, and guarantee that the fluid to be pumped is pressed from the suction connector line into the pressure connector line, by way of the rotor set.

A hydrostatic drive unit of a lawn tractor, based on a gerotor pump and a gerotor motor is described in U.S. Pat. No. 7,614,227 B2, in which the oil volume stream from the pump to the hydromotor is regulated by means of a rotating control valve in the embodiment of a rotating plate. In this design, disclosed in U.S. Pat. No. 7,614,227 B2, a stationary bearing plate is disposed between the rotating plate and the gerotor motor, in which plate a bearing bore, for rotatable mounting of the motor shaft, is disposed in the center. Furthermore, two kidney-shaped passage openings are disposed in this bearing plate, in the region of the pump chambers of the gerotor motor, so that the bearing plate simultaneously takes on the task of a guide body and so that regulation of the travel drive of the lawn tractor, i.e. regulation of its speed and of its travel direction, can be guaranteed in connection with the modules adjacent to the bearing plate, in accordance with the solution presented in U.S. Pat. No. 7,614,227 B2.

The gerotor pumps used as oil pumps in internal combustion engines serve for engine lubrication there, which has to be guaranteed over a temperature range of minus 40° C. all the way into the range of hot idle operation of approximately 160° C., for example, in motor vehicles.

Because almost all pump housings are produced from different materials, for reasons of cost and weight savings, such as the gear wheel sets disposed in the pump housing, in each instance, for example the pump housings are often produced from die-cast aluminum and the gear wheel sets are produced from sintered steel, the axial play between the gear wheel set and the pump housing necessarily changes over the great working range/temperature range of minus 40° C. to approximately 160° C., on the basis of the different heat expansion coefficients of aluminum and steel, as a function of the current operating temperature, in each instance. In this connection, friction losses mostly occur at low operating temperatures, as a result of tight dimensions, and losses in the degree of volumetric effectiveness occur at high operating temperatures, as a result of overly great gap dimensions, which losses can amount to as much as 50% to 60% of the most advantageous degree of volumetric effectiveness for the gear ring pump arrangement, in each instance.

In this connection, the degree of volumetric effectiveness decreases in approximately linear manner with increasing temperatures.

In the state of the art, the most varied solutions for optimizing the axial gap/axial play have therefore been proposed.

For example, a gear ring pump used as an oil pump is known from DE 103 31 979 A1, the axial play of which is optimized using spacer elements disposed in the region of the screw connections between the pump lid and the pump flange, in that these spacer elements have a lower heat expansion coefficient than the pump lid, the pump flange and/or the gear wheel set.

The axial play is reduced at high temperatures and increased at low temperatures as the result of the installation of such spacer elements, which are made of nickel steel, for example.

The installation of such spacer elements leads to an increase in the degree of volumetric effectiveness as compared with conventional pumps made of die-cast aluminum having gear wheel sets made of steel, of up to 40 to 50%, but in this connection it has the disadvantage that this solution requires a significant radial enlargement of the construction space of the respective pump since the spacer elements necessarily have to be disposed outside of the pump rotor diameter and within the pump housing.

A design of a gear ring pump that can be built with a smaller outside diameter is known from DE 10 2008 054 758 A1. In this design, two housing parts that are connected with one another and surround the gerotor are braced by means of suitable spring elements, relative to one another, in addition to the connection force, in order to minimize the axial gap.

However, this solution has the disadvantage that because of the components that lie against the rotor under spring bias, friction moments necessarily occur at the face side of the rotor, which result in great losses in the degree of effectiveness.

At the same time, the production and installation effort necessarily increases as the construction size decreases, on the basis of the construction and function elements integrated into the pump housing, such as the bearing locations for the drive shaft, the suction and pressure kidneys disposed in the pump housing, and the related connection channels.

Furthermore, the gap geometries have an over-proportional negative effect on the degree of effectiveness as the construction size decreases.

In order to now reduce the production precision and thereby the production effort, particularly as the construction size decreases, it was proposed, in the state of the art, to construct these housings, particularly of small gear ring pumps, in modular manner, i.e. to join them together from multiple components.

In these embodiments, elastomer seals are disposed between the adjacent components, in order to equalize tolerances.

In these solutions having elastic tolerance equalization, "residual tensions" necessarily occur when the adjacent components are braced against one another, and these in turn lead to friction moments at the face sides of the rotor set.

If, however, the adjacent components are braced against one another "just until" tolerance-related gaps still remain between them, then leakage losses occur at the rotor set, on the face side, with an increasing operating temperature, which losses, as has already been explained, have an over-proportionally great negative influence on the degree of effectiveness of gear ring pumps that have a very small construction.

In order to now reduce these losses in degree of effectiveness that result from leakage losses or from "bracing" of the elastomer seals against the rotor set, the production precision and thereby the production effort must be over-proportionally increased for axial gap compensation, particularly in the case of gear ring pumps having a very small construction.

In the state of the art, axially displaceable sealing plates disposed adjacent to the pump rotor set on both sides are also used for axial gap compensation, where cavities enclosed by elastomer seals are disposed on the side of the plates facing away from the pump rotor set, which cavities then have pressure applied to them in the operating state of the pump.

However, in the case of gear ring pumps having a small construction, this solution with axially displaceable sealing plates disposed adjacent to the pump rotor set on both sides is specifically not suitable for achieving an optimal degree of effectiveness at justifiable production costs.

However, at the same time, the use of these axially displaceable sealing plates with pressure application to a cavity disposed between the adjacent components and enclosed by elastomer seals brings about the result that furthermore, the interior cavity pressure also acts on the edge side of the elastomer seal, so that axial tolerance equalization with elastomer seals to which pressure is applied brings about the result, with a decreasing pump construction size, that the ratio of the "elastomer sealing force" and the hydraulically generated force becomes more and more disadvantageous, and that with a decreasing construction size of the gear ring pumps (e.g. in the case of gerotor pumps having a conveying volume stream of approximately 8 L/min and outside dimensions of approximately 40 mm×40 mm×40 mm), the non-calculable "interference forces" predominate, and then have a dominant effect on the overall degree of effectiveness of the pump.

SUMMARY OF THE INVENTION

The invention is therefore based on the task of developing a gear ring pump that eliminates the aforementioned disadvantages of the state of the art, and can be used, in particular, in the case of small pump assemblies, i.e. even those having a small outside housing diameter, which are preferably driven by an electric motor and are produced as modular pumps, in such a manner that housing blanks that have the same geometry, to the greatest possible extent, are used, whereby the gear ring pump to be developed is furthermore supposed to be easily modifiable in accordance with customer wishes, in each instance, in terms of the control times of the pump, by means of production technology, so that an optimal behavior of the pump according to the invention, in terms of flow technology, is always guaranteed, and, in this connection, it should also be possible to produce the gear ring pump to be developed very cost-advantageously, even in very small pump construction sizes, and furthermore to guarantee an optimal axial gap (and thereby minimal losses) even when using very cost-advantageous modules, such as pump housings made of aluminum and pump rotors made of steel, even under extreme conditions of use, i.e. over the entire working temperature range of such an oil pump, of approximately −40° C. to approximately 160° C., so that a high degree of effectiveness is always guaranteed over the entire speed of rotation and temperature range of such a pump, whereby the gear ring pump to be developed should, of course, always work reliably, robustly, and without susceptibility to breakdown, over the entire speed of rotation and temperature range.

According to the invention, this task is accomplished by a gear ring pump having the characteristics of the main claim of the invention.

Advantageous embodiments, details, and also further characteristics of the invention are evident from the dependent claims and from the following description of the exemplary embodiment according to the invention, in connection with the drawings relating to the solution according to the invention.

BRIEF DESCRIPTION OF THE DRAWINGS

In the following, the invention will now be explained in greater detail using an exemplary embodiment in connection with five representations.

These show.

DETAILED DESCRIPTION OF THE PREFERRED EMBODIMENTS

Figure 1:
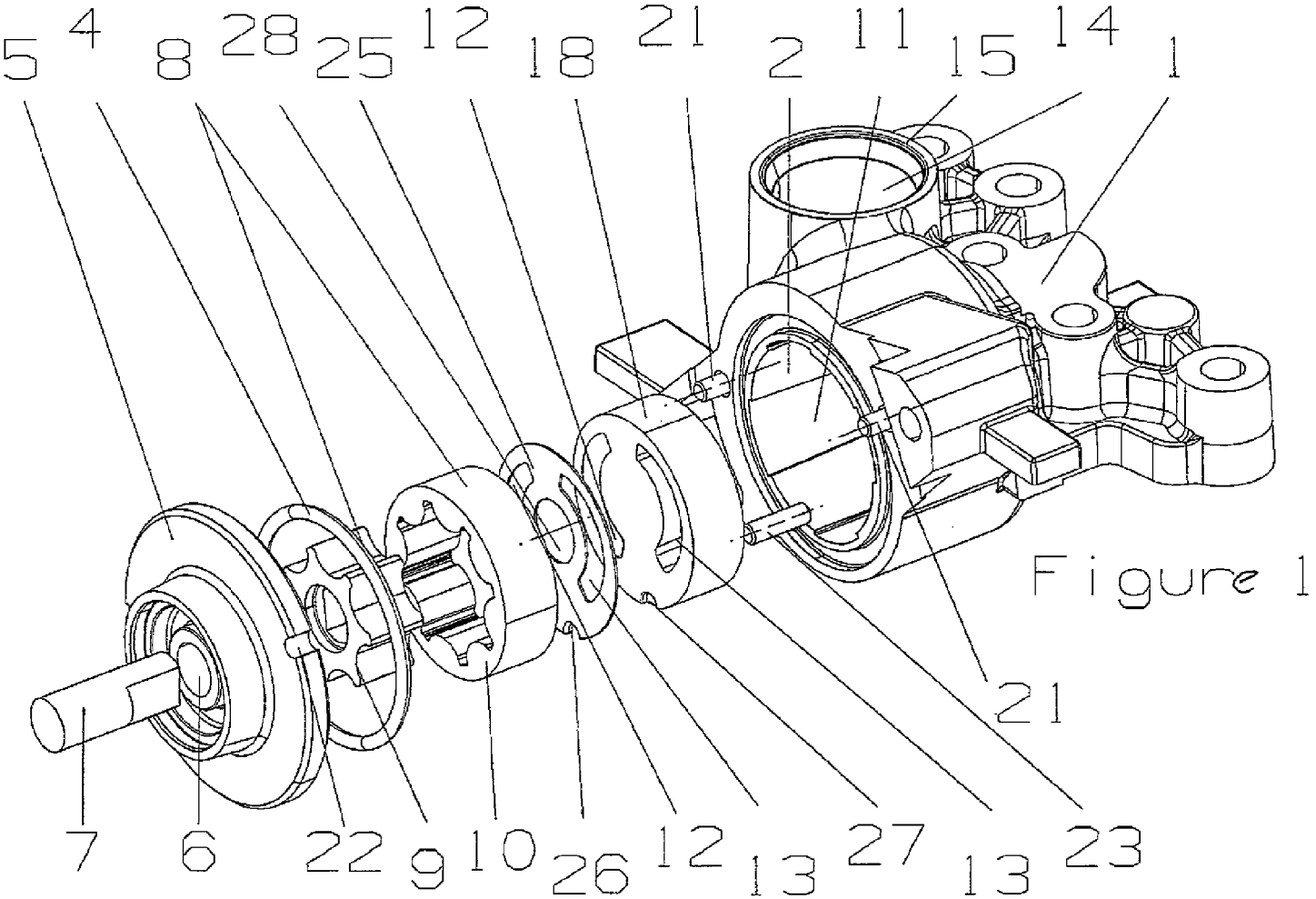
FIG. 1: an exploded representation of a gear ring pump according to the invention, in the design of a gerotor pump, in a perspective view from above, in the longitudinal direction of the drive shaft 7, from the direction of the housing lid 5.
Figure 2:
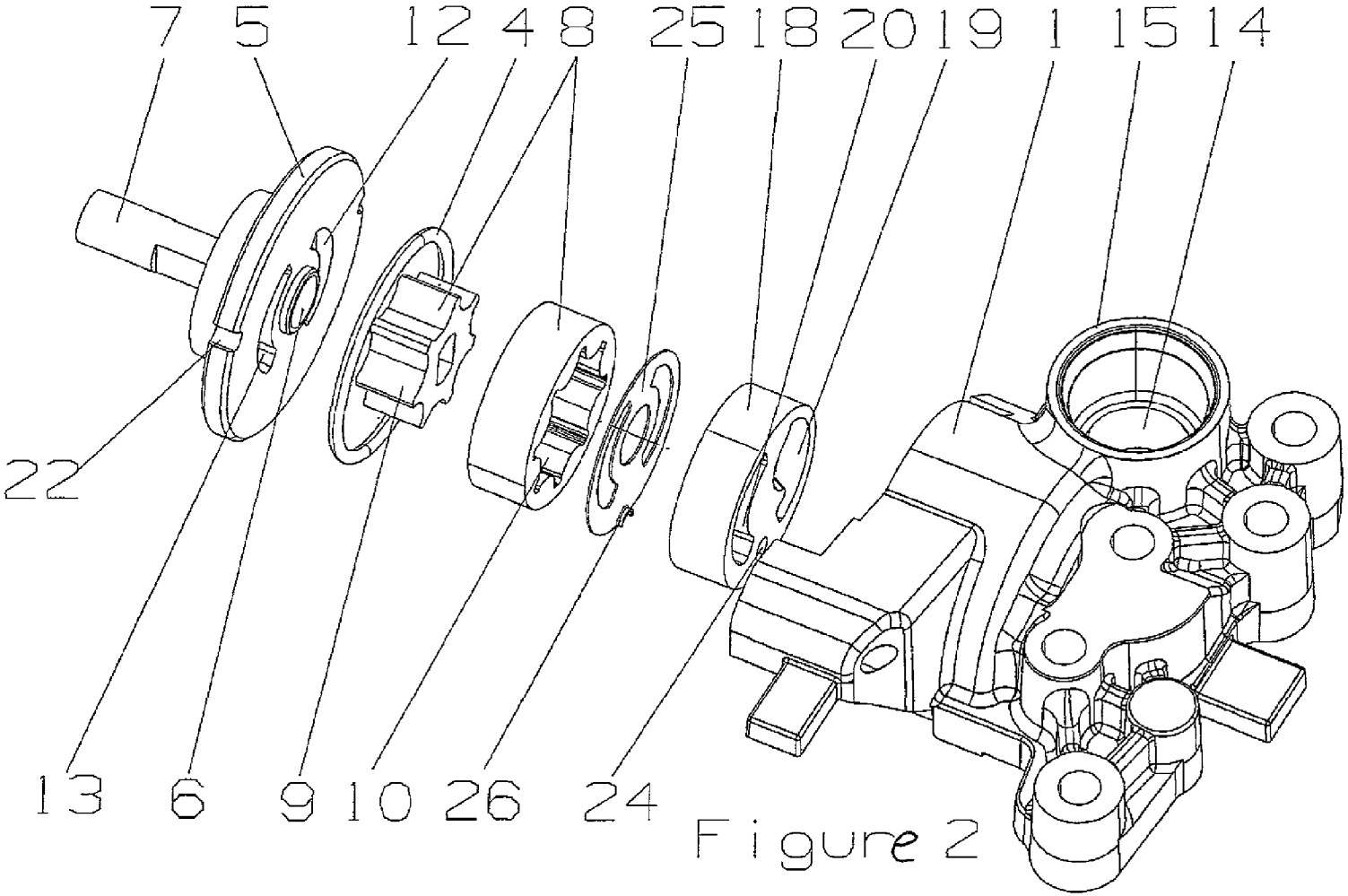
FIG. 2: an exploded representation of the gear ring pump according to the invention, in the design of a gerotor pump, in a perspective view from above, and from the direction of the pump housing 1.
Figure 3:
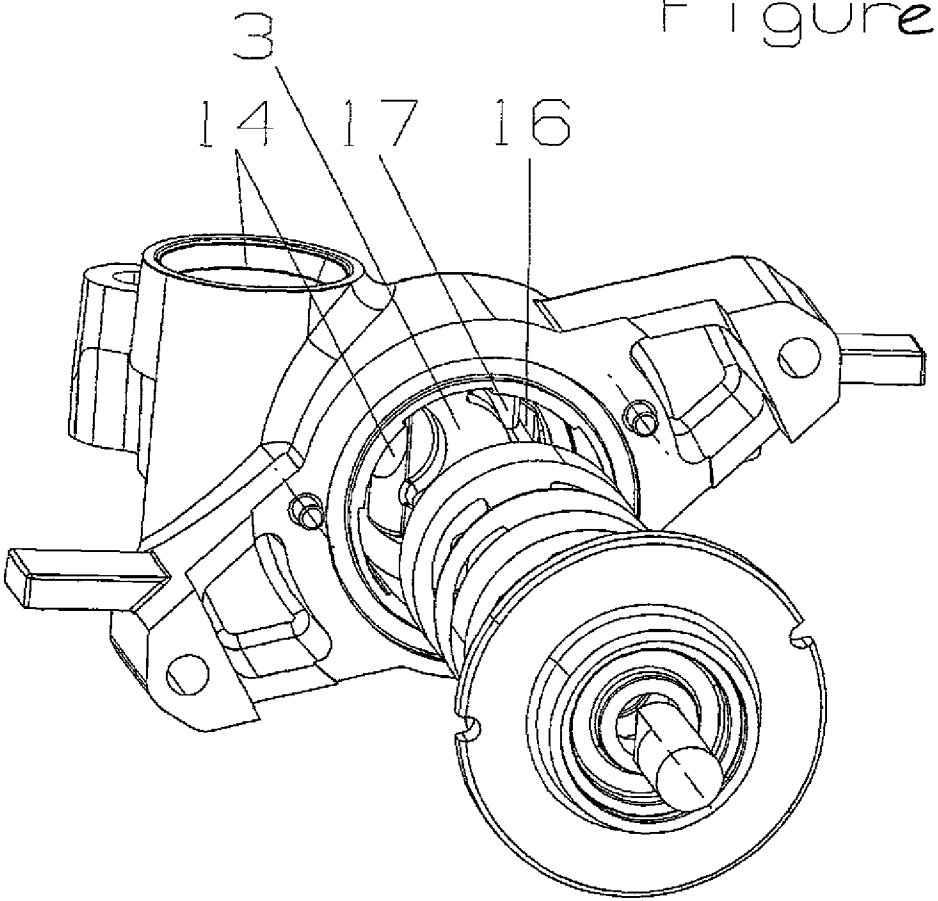
FIG. 3: an exploded representation of the gear ring pump according to the invention, in the design of a gerotor pump, in a perspective view from the front, from the direction of the drive shaft 7 and of the housing lid 5.
Figure 4:
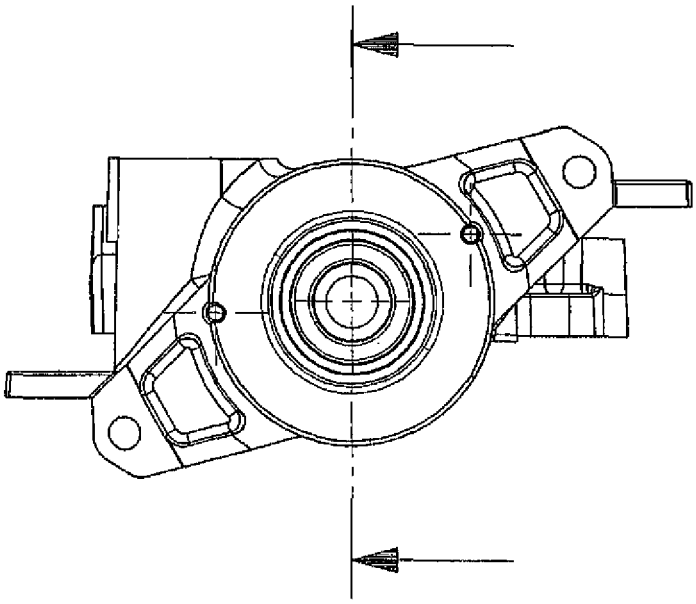
FIG. 4: a compilation drawing of the gear ring pump according to the invention, in the design of a gerotor pump, in a front view (looking at the lid), with the representation of the section line for FIG. 5.
Figure 5:
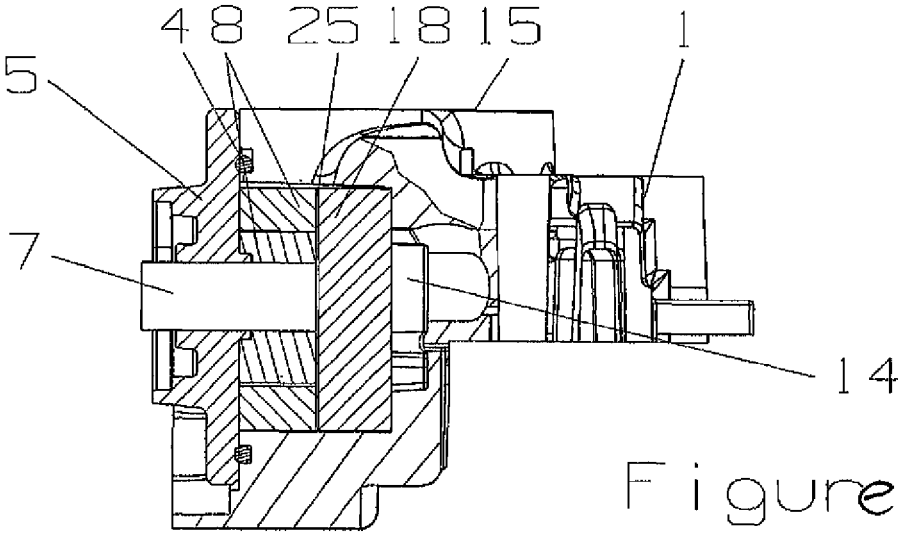
FIG. 5: a compilation drawing of the gear ring pump according to the invention, in the design of a gerotor pump, in a side view, in partial section along the section line according to FIG. 4.

The gear ring pump according to the invention shown in FIGS. 1 to 5, having a pump housing 1, a work space 2 disposed in the pump housing 1, having inflow and/or outflow regions disposed in the face wall 3 of the work space 2 in the pump housing 1, a housing lid 5 disposed on the pump housing 1, sealed off by means of a seal 4, having a drive shaft 7 disposed so as to rotate in the pump housing 1, mounted in a pump bearing 6, on which shaft a rotor set 8 is disposed, which consists of an inner rotor 9 having gear teeth on the outside, connected with the drive shaft 7 in torque-proof manner, and an outer rotor 10 having gear teeth on the inside, which is mounted so as to rotate in the cylindrical work space 2 of the pump housing 1, in a rotor bearing 11, in such a manner that the teeth of the inner rotor 9, which is mounted eccentric to the outer rotor 10, mesh with the teeth of the outer rotor 10 in certain regions, having (a) suction kidney(s) 12 disposed on one or both sides in the suction region of the rotor set 8, and (a) pressure kidney(s) 13 disposed on one or both sides of the pressure region of the rotor set 8, whereby the suction kidney(s) 12 is/are connected with at least one suction connector 15 disposed on the pump housing 1, by way of a/multiple suction channel 14/suction channels 14 disposed in the pump housing 1, and the pressure kidney(s) 13 is/are connected with at least one pressure connector 17 disposed on the pump housing 1, by way of a/multiple pressure channel 16/pressure channels 16 disposed in the pump housing 1, and the fluid to be pumped is pressed from the suction connector 15 into the pressure connector 17, by way of the rotor set 8 disposed in the pump housing 1, is characterized, among other things, in that the pump bearing 6 is disposed in the housing lid 5.

It is essential to the invention, in this connection, that a port support 18 is disposed in the pump housing 1, between the rotor set 8 and the face wall 3 of the work space 2, mounted in torque-proof manner and so as to be displaceable in the direction of the drive shaft 7, in which support not only a suction kidney 12 but also a pressure kidney 13 is disposed, and both penetrate the port support 18, separately from one another, in each instance, over the entire thickness of the port support 18, in the form of an inflow chamber 19 connected with the suction kidney 12 and, on the other hand, of an outflow chamber 20 connected with the pressure kidney 13, whereby the thickness of the port support 18 approximately corresponds to the thickness of the rotor set 8, and can, however, also project beyond this by up to 20%, and the heat expansion coefficient of the port support 18 lies above the heat expansion coefficient of the pump housing 1 by about 70% to 120%, and that the drive shaft 7, which is connected with the inner rotor 9 in torque-proof manner, by no means projects into the port support 18 (or is mounted in it).

It is furthermore characteristic that the port support 18 is configured to be wear-resistant or is coated to be wear-resistant on the face side adjacent to the rotor set 8, or that a slide plate 25 connected with the port support 18 in torque-proof manner is disposed between the rotor set 8 and the port support 18, thereby also minimizing the wear between the rotor set 8 and the port support 18, along with the friction losses, so that a long useful lifetime at a high degree of effectiveness can be guaranteed by means of the solution according to the invention.

In FIG. 1, a slide plate 25 disposed between the rotor set 8 and the port support 18 is shown as one of the possible designs of this characteristic, whereby an engagement projection 26 is disposed on the slide plate 25, which projection enters into interaction with a guide groove 27 disposed on the port support 18, with shape fit, and thereby connects the slide plate 25 with the port support 18 in torque-proof manner.

It is also essential, in this connection, that a suction kidney 12 assigned to the suction kidney 12 of the port support 18 and also a pressure kidney 13 assigned to the pressure kidney 13 of the port support 18 are also disposed in the slide plate 25, so that unhindered passage of the conveyed medium "through the slide plate" occurs.

It is also advantageous, in this connection, if a wave guide bore 28 is disposed in the slide plate 25.

By means of the introduction of the wave guide bore 28, the bending stiffness of the slide plate 25 is reduced, thereby making better contact with and adaptation to the rotor set 8 and the port support 18 possible. At the same time, a slight projection of the drive shaft 7 can be achieved with the wave guide bore 28.

It is also in accordance with the invention that the housing lid 5 is mounted on the pump housing 1 in torque-proof manner, by way of positioning pins 21 disposed in the pump housing 1 and positioning notches 22 disposed on the housing lid 5 and assigned to the positioning pins 21 disposed in the pump housing 1, and that the port support 18 is mounted on the pump housing 1 in axially displaceable manner, by means of a pin guide bore 24 disposed eccentrically in the port support 18 and a guide pin 23 disposed in the face wall 3 of the work space 2, assigned to the pin guide bore 24.

This arrangement according to the invention makes it possible, according to the invention, in connection with the placement of the port support 18 according to the invention, in the axial direction next to the rotor set 8 of the gear ring pump according to the invention, because the port support 18 depicts the inflow and outflow region of the pump in terms of its functional geometry, that in connection with the outer cylindrical geometry of the port support 18, according to the invention, the latter rotates in the pump housing 1 without problems, within certain limits, and can be positioned precisely, e.g. by means of guide pins 23 in the pump housing 1, with a secure position.

Thus, it is possible, for the first time, to optimize the control times of the pump, in terms of flow technology, to the case of use of the pump, in each instance, by means of the use, according to the invention, of the port support 18, according to the invention, by means of the adaptation related to the angle of rotation as described above.

Furthermore, the port support 18 according to the invention also serves, at the same time, to guarantee optimization of the axial gap.

For this purpose, materials having a heat expansion coefficient that has twice the value of the heat expansion coefficient of the housing material, if at all possible, are used for the port support 18, according to the invention.

In this connection, the thickness of the port support 18 approximately corresponds to the thickness of the rotor set 8.

However, in order to bring about over-compensation of the axial gap at a correspondingly desired axial basic play between the rotor set 8 and the port support 18, the thickness of the port support 18 can also be increased to approximately 120% of the thickness of the rotor set, for example 8.

In the present exemplary embodiment, having a pump housing 1 made of aluminum, modified duroplastics were used as materials for the port support 18, whereby the thickness of the port support varies, of course, as a function of the basic material used for the port support 18, in each instance.

However, specially modified duroplastic materials can also be used for the port support 18, which materials clearly improve the running behavior of the rotor set disposed adjacent, for example by means of targeted admixing of friction-reducing substances.

It is also in accordance with the invention if the port support 18 is produced from sintered and resin-bonded sodium chlorides.

By means of the use of sintered and resin-bonded sodium chlorides for the production of the port supports 18, a predetermined axial heat expansion of an aluminum pump housing having a heat expansion coefficient for aluminum of about $23\times10^{-6}$ $K^{-1}$ can be effectively compensated by means of a port support made of sintered and resin-bonded sodium chlorides, at a heat expansion coefficient for sodium chloride of about 40 . . . $44\times10^{-6}$ $K^{-1}$, i.e. with a relatively lesser thickness dimension of a port support 18 produced from sintered and resin-bonded sodium chlorides.

By means of the solution according to the invention, the axial gaps that are dependent on the operating temperature, in each instance, are thereby always optimized over their entire working temperature range of the pump, when using different materials for housing and rotor, i.e. optimal, dynamic axial gap compensation is guaranteed in cost-advantageous manner.

It also becomes possible, as a function of the selection of the material for the port support 18 in connection with the dimensioning of the thickness of the port support 18, to configure the axial gaps to be larger at low temperatures, and thereby to reduce the axial play at higher temperatures by means of clearly greater length expansion of the port support 18.

Such a tendency "supports" the natural viscosity behavior of diverse oil types and thereby leads to a pump that works significantly more efficiently overall.

A further advantage of the solution according to the invention also consists in that in the case of the axial gap compensation according to the invention as presented here, the rotor set 8 remains free of axial stresses, so that the friction moments that occur as a result of such stresses and necessarily always lead to losses in degree of effectiveness are avoided.

The temperature-compensating effect of the port support 18, according to the invention, which is placed next to the rotor set 8 in the axial direction, according to the invention, which effect is intended, according to the invention, brings about the result, in the case of a temperature increase and a resulting axial growth of the work space 2 in the pump housing 1 in which the rotor set 8 and the port support 18 are accommodated, that the axial growth of the work space 2 is balanced out by means of a clearly greater heat expansion of the port support 18 according to the invention, with simultaneous attention being paid to the growth of the rotor set 8.

In the case of over-compensated length equalization, the possibility exists, according to the invention, of setting the axial basic play at low temperatures to be relatively high, and thereby to counteract the viscosity behavior of the medium to be conveyed, in order to thereby reduce the drive power in the low temperature range of the gear ring pump according to the invention, and thereby to clearly increase the degree of effectiveness at this operating point, as well.

In this connection, the solution according to the invention makes it possible, as a result of the placement, according to the invention, of the port support 18, according to the invention, in connection with all the effects that have already been described, to furthermore simultaneously also allow the production of pump assemblies that have a small construction, in terms of the outside diameter of the housing.

REFERENCE SYMBOL SUMMARY

1 pump housing
2 work space
3 face wall
4 seal
5 housing lid
6 pump bearing
7 drive shaft
8 rotor set
9 inner rotor
10 outer rotor
11 rotor bearing
12 suction kidney
13 pressure kidney
14 suction channel
15 suction connector
16 pressure channel
17 pressure connector
18 port support
19 inflow chamber
20 outflow chamber
21 positioning pin
22 positioning notch
23 guide pin
24 guide pin bore
25 slide plate
26 engagement projection
27 engagement groove
28 wave guide bore

What is claimed is:

1. A gear ring pump comprising:

a pump housing, a cylindrical work space disposed in the pump housing, wherein the work space comprises a face wall and inflow and outflow regions disposed in the face wall, a housing lid disposed on the pump housing, a seal sealing off the pump housing, a pump bearing, a drive shaft disposed so as to rotate in the pump housing, mounted in the pump bearing, at least one suction connector disposed on the pump housing, at least one suction channel disposed in the pump housing, at least one pressure connector disposed on the pump housing, at least one pressure channel disposed in the pump housing, a rotor bearing disposed in the pump housing, a rotor set disposed on said drive shaft, the rotor set comprising an inner rotor and an outer rotor mounted eccentric to the inner rotor, a port support disposed in the pump housing between the rotor set and the face wall of the work space, at least one suction kidney, at least one pressure kidney, an inflow chamber connected with the at least one suction kidney, an outflow chamber connected with the at least one pressure kidney, and a slide plate connected with the port support and disposed between the rotor set and the port support, wherein said inner rotor comprises gear teeth on an outside portion of the inner rotor, wherein the inner rotor is connected to the drive shaft, wherein the outer rotor comprises gear teeth on an inside portion of the outer rotor, wherein the outer rotor is mounted so as to rotate in the work space of the pump housing, in the rotor bearing, in such a manner that the teeth of the inner rotor mesh with the teeth of the outer rotor, wherein the at least one suction kidney is connected with the at least one suction connector through the at least one suction channel, wherein the at least one pressure kidney is connected with the at least one pressure connector through the at least one pressure channel, wherein a fluid to be pumped is pressed from the suction connector into the pressure connector using the rotor set disposed in the pump housing, wherein the pump bearing is disposed in the housing lid, wherein the port support has a thickness and is mounted so as to be displaceable toward the drive shaft, wherein the port support defines the at least one suction kidney and the at least one pressure kidney, and both the at least one suction kidney and the at least one pressure kidney pass entirely through the port support, separately from one another, in each instance, over the thickness of the port support, wherein the thickness of the port support either corresponds to a thickness of the rotor set, or projects above the thickness of the rotor set by up to 20%, wherein a port support heat expansion coefficient of the port support lies above a pump housing heat expansion coefficient of the pump housing by 70% to 120%, wherein the drive shaft does not project into the port support, and wherein the port support is configured or coated to be wear-resistant on a face side of the port support adjacent to the rotor set.

2. The gear ring pump according to claim 1, wherein the housing lid is mounted on the pump housing, by positioning pins disposed in the pump housing and positioning notches disposed on the housing lid and assigned to the positioning pins disposed in the pump housing, and wherein the port support is mounted in the pump housing in axially displaceable manner, using a pin guide bore disposed eccentrically in the port support and a guide pin disposed in the face wall of the work space, assigned to the pin guide bore.

3. The gear ring pump according to claim 1, wherein the port support is produced from modified duroplastic.

4. The gear ring pump according to claim 1, wherein the port support is produced from sintered and resin-bonded sodium chlorides.

5. The gear ring pump according to claim 1, wherein a slide plate suction kidney assigned to the at least one suction kidney of the port support and a slide plate pressure kidney assigned to the at least one pressure kidney of the port support are also disposed in the slide plate.

6. The gear ring pump according to claim 5, wherein an engagement projection is disposed on the slide plate, which projection enters into interaction with a guide groove disposed on the port support.

7. The gear ring pump according to claim 5, wherein a wave guide bore is disposed in the slide plate.

* * * * *